United States Patent [19]

Huff et al.

[11] Patent Number: 5,030,036

[45] Date of Patent: Jul. 9, 1991

[54] METHOD OF ISOLATING CONTAMINATED GEOLOGICAL FORMATIONS, SOILS AND AQUIFERS

[75] Inventors: Ray V. Huff; Steven G. Axen; David R. Baughman, all of Golden, Colo.

[73] Assignee: ISL Ventures, Inc., Golden, Colo.

[21] Appl. No.: 200

[22] Filed: Jan. 5, 1987

Related U.S. Application Data

[63] Continuation-in-part of Ser. No. 674,026, Nov. 21, 1984, Pat. No. 4,634,187.

[51] Int. Cl.[5] ..... E02D 3/12

[52] U.S. Cl. ..... 405/266; 405/271; 405/281

[58] Field of Search ..... 299/4; 405/59, 258, 405/266; 166/271, 281

[56] References Cited

U.S. PATENT DOCUMENTS

| | | | |
|---|---|---|---|
| 3,309,141 | 3/1967 | Fitch et al. | 299/5 |
| 3,690,106 | 9/1972 | Tregembo et al. | 405/266 |
| 4,311,340 | 1/1982 | Lyons et al. | 299/4 |
| 4,634,187 | 1/1987 | Huff et al. | 299/4 |

*Primary Examiner*—Dennis L. Taylor
*Assistant Examiner*—John Ricci
*Attorney, Agent, or Firm*—Dorr, Carson, Sloan & Peterson

[57] ABSTRACT

A method of isolating a contaminated geological formation or aquifer is disclosed in which the formation is encapsulated by impermeable barriers. A grid of wells is drilled into the formation. A horizontal barrier is formed below the contaminated formation by creating an overlapping pattern of horizontally-oriented fractures filled with polymer radiating from each of these wells. A horizontal barrier may also be formed above the top surface of the contaminated formation if necessary. A ring of boundary wells may also be drilled surrounding the contaminated formation. The strata around each boundary well are fractured, and a polymer is then injected to form a vertical barrier around the periphery of the contaminated formation. In addition, water may be injected under pressure into guard wells between the contaminated formation and the vertical and/or horizontal barriers to further reduce any migration of pollutants into neighboring formations.

2 Claims, 3 Drawing Sheets

METHOD OF ISOLATING CONTAMINATED GEOLOGICAL FORMATIONS, SOILS AND AQUIFERS

RELATED APPLICATION

This application is a continuation-in-part of U.S. application Ser. No. 674,026, "Method of In-situ Leaching of Ores," filed Nov. 21, 1984, Pat. No. 4,634,187.

FIELD OF THE INVENTION

The present invention relates generally to control of ground water pollution, and prevention of diffusion of pollutants through geological formations surrounding waste sites. More specifically, the present invention is a method of forming impermeable barriers to encapsulate or isolate contaminated geological formations, soils, and aquifers.

BACKGROUND OF THE INVENTION

Many approaches have been used to contain or isolate pollutants to limit contamination of soil and ground water. This problem is particularly acute where hazardous waste is stored in ponds or drums. Conventional technology in the field involves placing liners made of clay, cement, or plastic around and under the pond or drums to control seepage of pollutants into the surrounding soil and ground water. This approach is suitable where a liner can be installed before pollutants are released. However, liners have limited usefulness in situations where a release of pollutants has previously occurred. In the case of the Lowry landfill near Denver, Colo, pollutants have seeped to a vertical depth of several hundred feet below the earth's surface and contaminated ground water aquifers. Similar situations exist at a number of other hazardous waste sites. The available remedies in these cases are generally limited to excavation of the contaminated soil or treatment of pollutants by means of chemical, solvent, or biological techniques.

Chemical grouting has long been used in a variety of applications to control migration or flow of fluids. Cement or polymeric grouts have long been used in the oil industry and in in-situ leaching of minerals to control migration of oil, natural gas, and ground water, and to prevent the escape of lixiviants, solvents, or working fluids into surrounding formations. In applications of this type, a grout curtain is formed by drilling a series of closely-spaced wells in which grouting material is injected under pressure. For example, polymeric grouting was used to decrease the permeability of a natural formation in the course of constructing the Rocky Reach Hydroelectric Project in Wenatchee, Wash., in the late 1950's. Similar grout curtains have been used to prevent leakage from cooling ponds at power plants. Several examples of these types of application are provided in R. H. Karol, *Chemical Grouting,* (Marcel Dekker, Inc. 1983).

In the field of in-situ mining, directional drilling combined with hydraulic fracturing has been used in the past to encapsulate the ore body. For example, Lyons, et al., U.S. Pat. No. 4,311,340, "Uranium Leaching Process and Insitu Mining," issued Jan. 19, 1982, teaches that hydraulic fracturing of boreholes may be employed to create cracks and passage ways in the strata surrounding the boreholes to facilitate greater penetration of the grout or other impermeable materials (columns 7–8). Lyons also discloses that organic polymers and epoxy resins, as well as a wide variety of other materials can be used to create this impermeable barrier. The primary limitation of this approach is the manner in which horizontal barriers are formed above and below the ore body. Lyons relies on slanted boreholes formed by directional drilling for this purpose, as shown in FIGS. 5–11. While this technique may be effective for a relatively small geological formation or aquifer, it quickly becomes impractical when dealing with a large formation, particularly one having a large horizontal cross section. In such cases, a radial arrangement of slanted boreholes does not result in a uniform degree of encapsulation due to radial diversion of the boreholes. Directional drilling also entails additional costs.

In contrast, the present invention overcomes these shortcomings by using a grid of vertical boreholes to create an overlapping grid of horizontally-oriented fractures above and/or below the contaminated formation that is then injected with a cement or polymeric grout. In addition, a vertical grout curtain can be installed about the periphery of the contaminated formation to provide complete encapsulation. The grid of boreholes also provides a ready means for monitoring or treatment of the contaminated formation, or for removal of pollutants from the formation.

SUMMARY OF THE INVENTION

In accordance with the present invention, a contaminated geologic formation or aquifer is isolated from the surrounding formations by forming a number of impermeable barriers around the contaminated formation. In particular, an overlapping pattern of horizontally-oriented fractures radiating from a grid of boreholes are created by hydraulic fracturing. The fractures and surrounding strata are then saturated with a polymer or other impermeable material. This procedure can be used to form horizontal barriers either above or below the formation. In situations where impermeable barriers are required both above and below the formation, the same set of boreholes can be used to form both impermeable barriers. A vertical barrier can be formed by drilling a series of boreholes around the periphery of the formation. Horizontally-oriented fractures are created and injected with a polymer or other suitable material to tie into the horizontal barrier above and/or below the formation. The remainder of the bore holes can also be fractured, if necessary. In any event, a polymer or other suitable material is then injected into the bore holes around the periphery of the formation to complete the vertical barrier. Additional wells can be drilled into the formation enclosed by the impermeable barriers and injected under pressure with water to further minimize diffusion of pollutants from the formation.

Accordingly, a principal object of the present invention is to provide a more effective and economical method of isolating contaminated geological formations or aquifers to prevent diffusion of pollutants.

Another object of the present invention is to provide a method of isolating contaminated geological formations or aquifers that can be used after a release of pollutants has occurred, without the need to first excavate or remove the contaminated material.

Still other objects, features, and advantages of the present invention will be made apparent by the following detailed description, the drawings, and the claims.

DETAILED DESCRIPTION OF THE INVENTION

Figure 1:
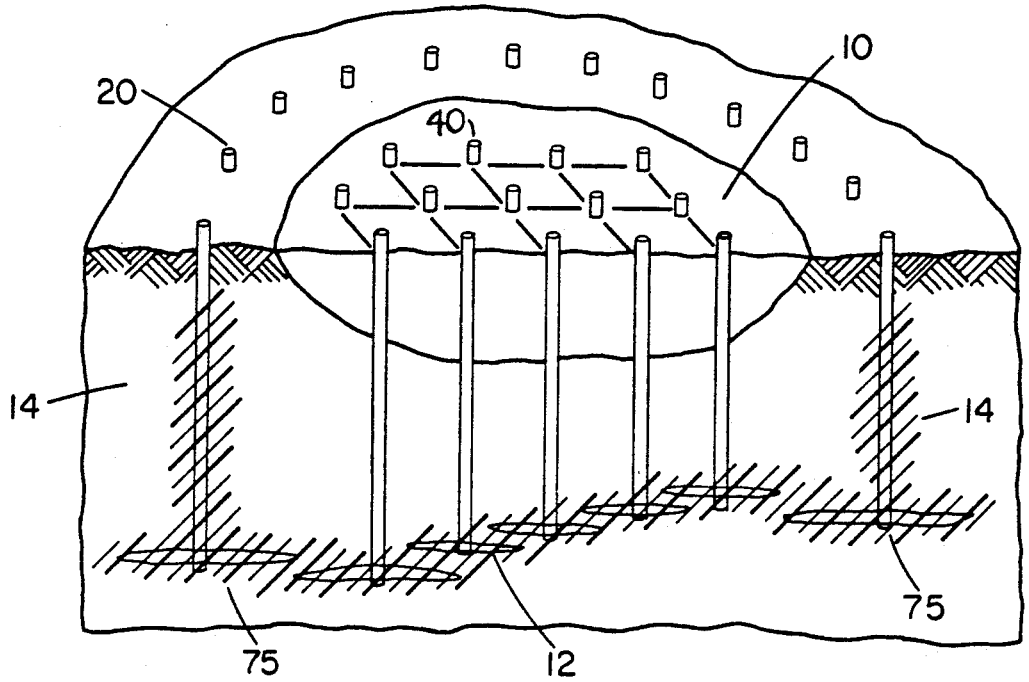
FIG. 1 is a schematic representation of a cross section of the earth's structure, showing a contaminated geological formation, a ring of barrier wells surrounding the formation, and a grid of boreholes through the formation used to form a horizontal barrier beneath the formation.

Turning to the drawings, FIG. 1 is a cross section of the earth's structure showing a contaminated geological formation or aquifer 10 that has been encapsulated by an impermeable horizontal barrier 12 and vertical barrier 14. Viewed from the surface of the earth, the contaminated formation is surrounded by a ring of boundary wells 20 used to create the vertical barrier 14. A horizontal barrier 12 is formed beneath the contaminated formation 10 by means of the grid of wells 20 and the ring of boundary wells 40.

Figure 3:
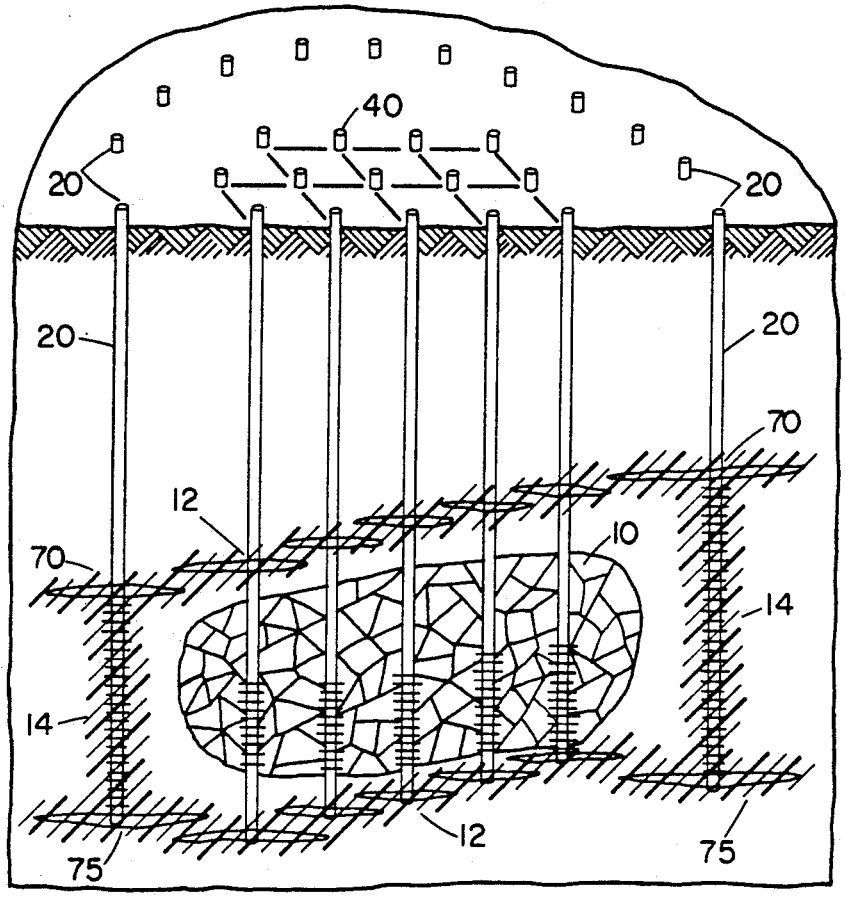
FIG. 3 is another schematic representation of a cross section of the earth's structure similar to FIG. 1, further showing an additional encapsulating horizontal barrier located above the contaminated formation.

FIG. 3 shows an alternative embodiment of the present invention wherein horizontal barriers 12 are formed both above and below a subterranean formation or aquifer to completely encapsulate the pollutants.

Figure 4:
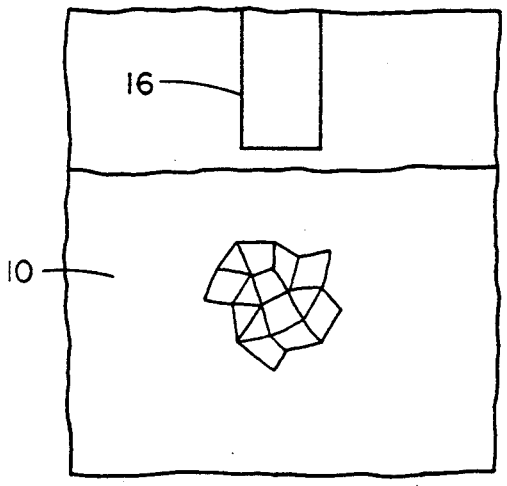
FIG. 4 is a schematic representation of the bottom end of a borehole directly above the top surface of the contaminated formation, as shown in FIG. 3.
Figure 5:
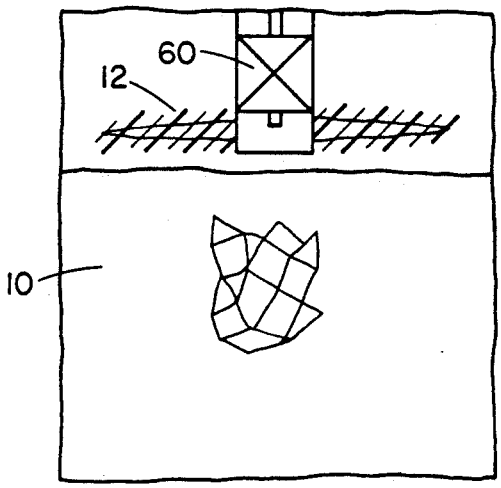
FIG. 5 is a schematic representation of the borehole in FIG. 4, further showing a hydraulic packer and a horizontally-oriented fracture filled with impermeable material extending above the top surface of the formation.

FIGS. 4 through 8 give a step-by-step progression of the method employed to form the horizontal barriers for a typical borehole in conformance with embodiment shown in FIG. 3. As shown in FIG. 4, a borehole 16 is drilled by conventional means from the surface of the earth to a point above the top surface of the contaminated formation where the upper horizontal barrier is to be created. A hydraulic packer 60 is then lowered into the borehole, as shown in FIG. 5, and the strata surrounding the borehole below the packer is hudraulically fractured by injecting fluid at high pressure through the packer into the bottom end of the borehole. The orientation and extent of fracturing can be predicted with some degree of certainty based on the physical characteristics of the strata and the stress conditions of the formation. The technology in this area has been well developed in the petroleum industry. See, G. C. Howard & C. R. Fast, *Hydraulic Fracturing* (Monograph Volume 2, Society of Petroleum Engineers of A.I.M.E., 1970). After creating the horizontally-oriented fractures, an impermeable material such as a plastic polymer, epoxy resins, silica gel, cement or grout is injected through the packer into the fractured formation to create the impermeable barrier 12. Polymers of the polyacrylamide family are particularly appropriate for this purpose and are available on the market under product names such as American Cyanamid Cyanogel 100 or 150, Halliburton Services KTROL, and Dow Well M-174.

Figure 6:
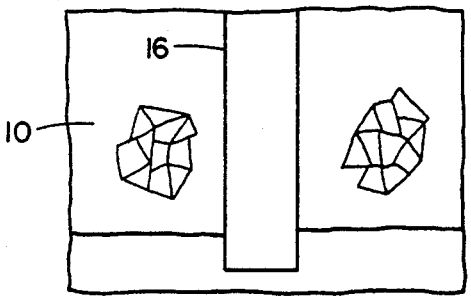
FIG. 6 is a schematic representation showing the borehole continued down below the bottom of the formation.
Figure 7:
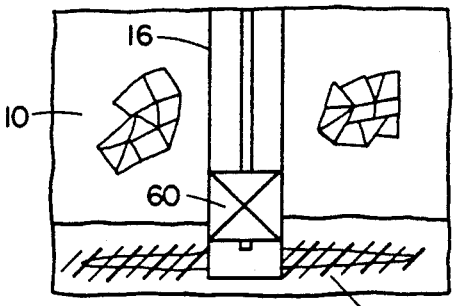
FIG. 7 is a schematic representation showing a hydraulic packer and a horizontally-oriented fracture filled with impermeable material extending below the bottom surface of the formation.
Figure 8:
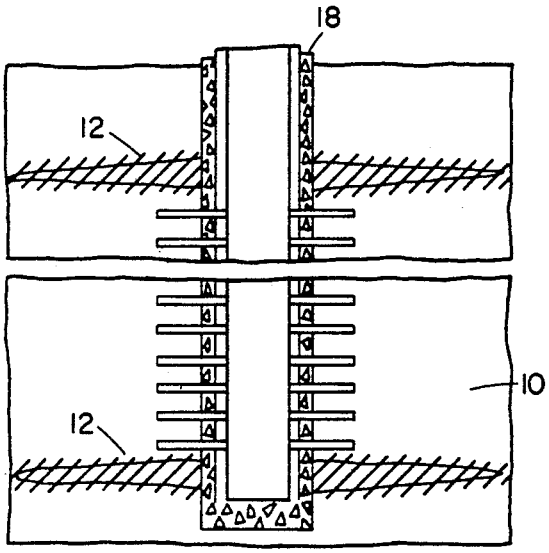
FIG. 8 is a schematic representation of a barrier well located at the periphery of the formation, but otherwise created by the method shown in FIGS. 3 through 7.

After this upper horizontal barrier has had ample time to solidify or set, drilling of the borehole 16 is continued through the contaminated formation 10 and slightly beyond into the formation below, as shown in FIG. 6. Once again, a packer 60 is lowered to the bottom of the borehole and the formation around the bottom of the borehole was fractured and injected with an impermeable material, as shown in FIG. 7. The well may then be completed in a conventional manner with a casing and cement 18 as shown in FIG. 8. The casing and cement are perforated by means of shaped explosive charges to allow the formation to be injected into, or drain out of the contaminated formation.

The optimal spacing of the grid of wells will vary widely depending primarily on the permeability of the formation and the radius of fracturing associated with the horizontal barriers about each borehole. The spacing of the grid should be small enough to allow the horizontal barriers to overlap, so as to prevent migration of the pollutants into neighboring formations. With adequate fracturing of formations having a suitably high permeability, the grid spacing may be as great as 50 feet or more.

This method of creating horizontal barriers provides a substantial advantage in that the barriers can be contoured to follow irregularities in the top or bottom surfaces of the contaminated formation. Although the fractures radiating from the boreholes have a primarily horizontal orientation, migration of the barrier-forming material into the strata results in horizontal barriers having a substantial vertical thickness. Thus, neighboring horizontal fractures need not be in strict horizontal alignment in order to overlap. By progressively increasing or decreasing the vertical depth of the horizontally-oriented fractures, a sloping barrier can be formed in steps. Similarly, the vertical depth of the horizontally-oriented fractures can be varied over a small portion of the grid to compensate for irregularities in the surface of the contaminated formation.

Alternatively, the horizontal barriers can be formed using less than all of the grid wells. For example, if the formations are relatively permeable or if the radius of fracturing is sufficiently great, creating horizontally-oriented fractures only from every second borehole in the grid may be satisfactory to complete the horizontal barriers.

Figure 9:
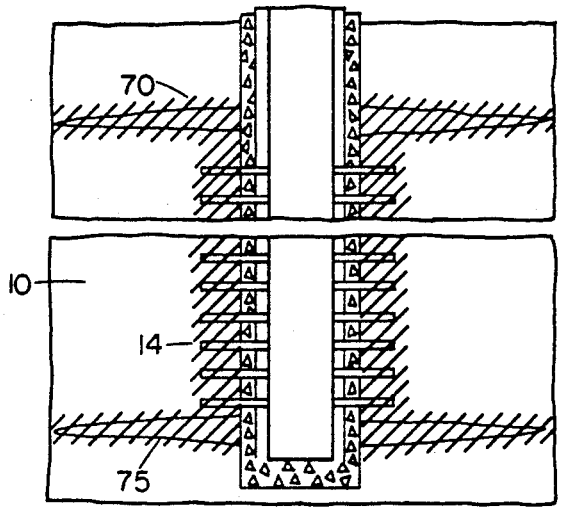
FIG. 9 is a schematic representation of a completed barrier well filled with impermeable material.

Vertical barriers 14 are formed in a similar manner for each boundary well around the periphery of the formation, or any desired section thereof. Although the boundary wells are usually located outside of the contaminated formation, horizontally-oriented fractures 70 and 75 are generally created in accordance with the method described in FIGS. 4 through 9, in order to complete the edges of the overlapping grid of horizontal fractures from the grid wells. In order to avoid gaps in the vertical barrier around the periphery of the formation, there must be some degree of overlap in areas saturated with impermeable material radiating from each set of neighboring boundary wells. The entire length of the borehole for each boundary well may be hydraulically fractured between the upper and lower horizontal barriers to increase permeability of the barrier-forming material into the surrounding strata. However, if the native permeability of the surrounding strata is sufficiently great, the need for fracturing may be reduced or entirely eliminated. In either case, the boundary wells are usually cased and cemented. FIG. 9 shows a completed boundary well that has been injected with an impermeable material saturating the formation around the boundary well between the upper and lower horizontal barriers through the perforations in the casing and cement.

The purpose of the preceding steps is to completely encapsulate the contaminated formation in all directions. Horizontal migration of the pollutants out of the formation is prevented by the vertical barrier 14 of impermeable material injected through the ring of boundary wells about the periphery of the contaminated formation. As previously discussed, the overlapping pattern of horizontally-oriented fractures, injected with impermeable material, radiating from the grid wells creates horizontal barriers 12 above and/or below the formation. The horizontally-oriented fractures 70 and 75 above and below the formation radiating from the boundary wells complete the encapsulation by joining together the edges of the horizontal barriers and the vertical barrier.

The preceding discussion has assumed the complete encapsulation of the formation by artificial means is necessary. This is not always the case. For example, if some portion of the contaminated formation is bounded by a relatively impermeable natural formation, that portion of the artificial barrier that would otherwise be created using the present invention can be accordingly reduced or eliminated. In particular, if the contaminated formation lies directly above or below an impermeable strata, the corresponding upper or lower horizontal barrier can be omitted.

Figure 2:
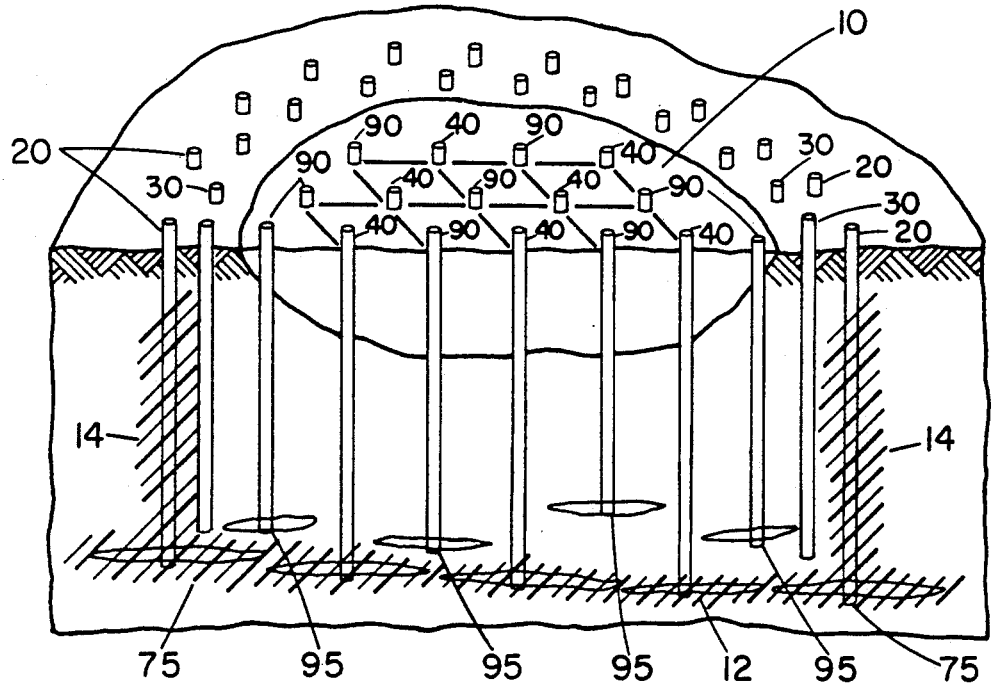
FIG. 2 is another schematic representation of a cross section of the earth's structure similar to FIG. 1, further showing the use of guard wells to inject water into the formation inside the impermeable barriers.

FIG. 2 shows a ring of guard wells 30 within the boundary wells. Ideally the horizontal and vertical barriers described above will be highly effective in containing the pollutants within the contaminated formation. However, to minimize the effect of any gaps or leakages in the barriers, the guard wells are pressurized with water. This tends to negate any pressure gradient that would otherwise tend to cause pollutants to migrate outward into neighboring formations.

The general concept of pressurizing the boundary of the contaminated formation with water to minimize migration of the pollutants into neighboring formations can be extended to the horizontal barriers as well, as further shown in FIG. 2. In addition to the ring of guard wells 30, additional guard wells 90 are employed to inject water under pressure between the horizontal barriers and the contaminated formation. The guard wells are drilled to a depth below the bottom surface of the contaminated formation, and above the top surface of the horizontal barrier. A hydraulic packer is then lowered into the borehole, and the strata surrounding the bottom of the borehole is fractured to create an overlapping pattern of horizontally-oriented fractures 95, similar to the method used to create the horizontal barrier. The borehole of each guard well is lined and cemented. However, instead of injecting material to form an impermeable barrier in the fractures at the bottom of the guard wells, the fractures are propped open by injecting sand or glass beads. Water is then injected under pressure into the guard wells 30 and 90.

Figure 10:
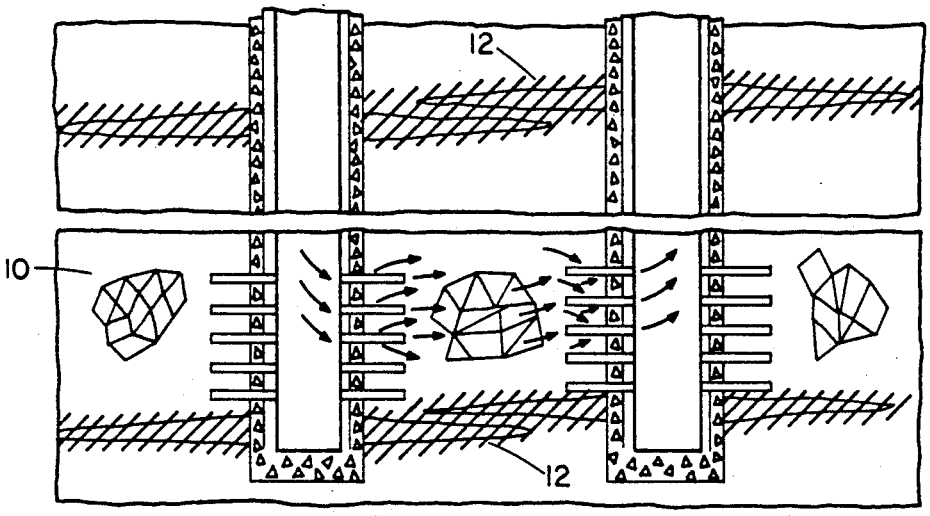
FIG. 10 is a schematic representation showing the flow of water or other fluid between neighboring boreholes for the purpose of flushing or treating the contaminated formation.

Following completion of the impermeable barriers and guard wells, the remaining grid wells 40 can be used for treatment or extraction of pollutants in the contaminated formation as shown in FIG. 10. Pollutants can be extracted by introducing solvents under pressure into some of these wells while reducing pressurization of other wells so as to create any desired pattern of fluid flow through the contaminated formation. For example, alternate wells in the grid can be used for injection of solvent and extraction of pollutants. Alternatively, chemical or biological agents can be introduced into the contaminated formation for in-situ treatment of pollutants.

It will be apparent to those skilled in the art that many variations and modifications of the present invention ma be made without departing from the spirit and scope of the invention.

We claim:

1. A method of isolating a contaminated geological formation comprising:

(a) drilling a number of wells through the formation;

(b) creating an overlapping pattern of horizontally-oriented fractures in the strata around the bottom of said wells, and injecting into said fractures and the surrounding strata a material to form an impermeable barrier;

(c) drilling a number of boundary wells about the periphery of the geological formation, and injecting into each boundary well and the surrounding strata a material to create an impermeable barrier;

(d) drilling a number of guard wells to a depth above the impermeable barrier below the formation;

(e) creating an overlapping pattern of horizontally-oriented fractures in the strata around the bottom of said guard wells; and (f) injecting water into the guard wells under pressure.

2. A method of isolating a contaminated geological formation comprising:

(a) drilling a number of wells through the formation;

(b) creating an overlapping pattern of horizontally-oriented fractures in the strata around the bottom of said wells, and injecting into said fractures and the surrounding strata a material to form an impermeable barrier;

(c) drilling a number of boundary wells about the periphery of the geological formation, and injecting into each boundary well and the surrounding strata a material to create an impermeable barrier;

(d) drilling a ring of guard wells within the ring of boundary wells; and (e) injecting water into the guard wells under pressure.

* * * * *